US008561541B2

(12) United States Patent
Pfersmann

(10) Patent No.: US 8,561,541 B2
(45) Date of Patent: Oct. 22, 2013

(54) PROPELLANT CHARGE BODY

(75) Inventor: Axel Pfersmann, Feucht (DE)

(73) Assignee: Diehl BGT Defence GmbH & Co. KG, Ueberlingen/BRD (DE)

( * ) Notice: Subject to any disclaimer, the term of this patent is extended or adjusted under 35 U.S.C. 154(b) by 16 days.

(21) Appl. No.: 13/232,497

(22) Filed: Sep. 14, 2011

(65) Prior Publication Data

US 2012/0060714 A1 Mar. 15, 2012

(30) Foreign Application Priority Data

Sep. 14, 2010 (DE) ..... 10 2010 045 383

(51) Int. Cl.
*F42B 5/18* (2006.01)

(52) U.S. Cl.
USPC ..... 102/431; 102/289; 102/282

(58) Field of Classification Search
USPC ..... 102/283, 285, 286, 289, 290, 292, 431, 102/282, 432
See application file for complete search history.

(56) References Cited

U.S. PATENT DOCUMENTS

| | | | | |
|---|---|---|---|---|
| 35,949 | A * | 7/1862 | Potter | 102/431 |
| 99,078 | A * | 1/1870 | Gomez | 102/430 |
| 702,208 | A * | 6/1902 | Hayner | 102/431 |
| 3,713,395 | A * | 1/1973 | Carpenter et al. | 102/290 |
| 3,815,506 | A * | 6/1974 | Tamulevich et al. | 102/290 |
| 6,688,232 | B2 * | 2/2004 | Griesbach et al. | 102/288 |
| 7,469,640 | B2 * | 12/2008 | Nielson et al. | 102/336 |
| 2007/0056461 | A1 | 3/2007 | Konicke | |

FOREIGN PATENT DOCUMENTS

| | | | |
|---|---|---|---|
| DE | 26 51 653 | A1 | 5/1978 |
| DE | 2651653 | A * | 5/1978 |
| DE | 38 15 436 | A1 | 11/1989 |
| DE | 691 11 944 | T2 | 4/1996 |
| EP | 1 731 867 | A1 | 12/2006 |

OTHER PUBLICATIONS

English translation of DE 26 51 653 A1, May 18, 1978.*

* cited by examiner

*Primary Examiner* — James Bergin
(74) *Attorney, Agent, or Firm* — Laurence A. Greenberg; Werner H. Stemer; Ralph E. Locher

(57) ABSTRACT

A propellant charge body for insertion into a propellant charge chamber in a firearm for firing caseless ammunition has a base body which contains a propellant charge. The diameter of the base body is less than the internal diameter of the propellant charge chamber. Radial projections are formed in one or more subareas on the circumference of the base body and match the radius of the base body in these subareas to the internal radius of the propellant charge chamber.

18 Claims, 3 Drawing Sheets

PROPELLANT CHARGE BODY

CROSS-REFERENCE TO RELATED APPLICATION

This application claims the priority, under 35 U.S.C. §119, of German application DE 10 2010 045 383.8, filed Sep. 14, 2010; the prior application is herewith incorporated by reference in its entirety.

BACKGROUND OF THE INVENTION

Field of the Invention

The invention relates to a propellant charge body for insertion into a propellant charge chamber in a firearm for firing caseless ammunition. The propellant charge body has a base body which contains a propellant charge means and whose diameter is less than the internal diameter of the propellant charge chamber. Propellant charge bodies such as these for insertion into a propellant charge chamber in a firearm for firing caseless ammunition are known in modern defence technology. A firearm such as this for firing caseless ammunition is known, for example, from the commonly assigned Patent Application Publication Pub. No. US 2007/0056461 A1 and its counterpart European patent EP 1 731 867 B1. There, the projectile and the propellant charge body are associated with a respectively autonomous projectile chamber and propellant charge chamber, which are aligned coaxially with respect to the bore axis of the firearm in the firing position.

Conventional propellant charge bodies have a base body which contains a propellant charge means and whose diameter is less than the internal diameter of the propellant charge chamber. The reason for the reduced diameter of the propellant charge body is the composition and the combustion characteristic, associated with it, of the propellant charge body. Modern propellant charge bodies therefore comprise propellant charge grains which are compressed with one another by means of a binding agent and are designed to granulate into individual grains on ignition of the propellant charge body. The way in which the individual powder grains are held together in the powder is in this case two orders of magnitude stronger than the way in which the powder grains are held together by the binding agent. The action area for the flame front in the propellant charge chamber is enlarged suddenly by granulation which is as complete as possible on the ignition of the propellant charge body. Internal ballistics which build homogeneously and above all are reproducible are achieved by the defined combustion of the separated powder grains which immediately follows this. Since the propellant charge body, which has been granulated to form individual propellant charge grains, has a greater volume than the propellant charge body as initially compressed, propellant charge bodies have been used with a smaller diameter than the internal diameter of the propellant charge chamber, in order that the propellant charge body has sufficient space to break up (i.e., granulate) into its individual powder grains.

One disadvantage of these conventional propellant charge bodies was that the center longitudinal axis of the propellant charge body after insertion into the propellant charge chamber did not coincide exactly with the center longitudinal axis of the propellant charge chamber. In some circumstances, this makes it harder to ignite the propellant charge body, which is in general done via an ignition means which is arranged on an extension of the center longitudinal axis of the propellant charge body. However, because the ignition initiation mechanism is arranged on an extension of the longitudinal axis of the propellant charge chamber, an offset between the center longitudinal axes of the propellant charge body and propellant charge chamber can result in misfires. A further disadvantage of the conventional propellant charges bodies with a smaller diameter than the internal diameter of the propellant charge chamber is the risk of tilting during insertion of the propellant charge body into the propellant charge chamber.

SUMMARY OF THE INVENTION

It is accordingly an object of the invention to provide a propellant charge body which overcomes the above-mentioned disadvantages of the heretofore-known devices and methods of this general type and which provides for an improved such device in which it is nevertheless ensured that the propellant charge body is granulated as completely as possible.

With the foregoing and other objects in view there is provided, in accordance with the invention, a propellant charge body for insertion into a propellant charge chamber in a firearm for firing caseless ammunition. The propellant charge body comprises:

- a base body containing a propellant charge means and having a diameter less than an internal diameter of the propellant charge chamber; and
- radial projections formed in one or more subareas on a circumference of the base body, the radial projections projecting from the base body and matching a radius of the base body in the one or more subareas to an internal radius of the propellant charge chamber.

In other words, the objects of the invention are achieved in that radial projections are arranged in one or more subareas on the circumference of the base body and match the radius of the base body in these subareas to the internal radius of the propellant charge chamber. These radial projections on the one hand center the base body advantageously in the propellant charge chamber while on the other hand leaving sufficient free space between the radial projections to ensure complete granulation on ignition of the propellant charge body.

The base body preferably has the radial projections on respectively opposite sides of the circumference. In this case, the radial projections can each be arranged in pairs axially symmetrically with respect to the center longitudinal axis of the propellant charge body. This allows the propellant charge body to be centered particularly exactly in the propellant charge chamber.

In one preferred embodiment of the present invention, the radial projections are in the form of ribs. In particular, ribs means elongated outward bulges which have a greater extent in one direction than transversely with respect to this direction. Radial projections in the form of ribs can be produced easily, and may have additional advantageous features, depending on the alignment.

For example, at least one or more of the ribs may run parallel to the longitudinal axis of the propellant charge body. A rib orientation such as this has an advantageous effect on the capability to insert the propellant charge body into the propellant charge chamber.

However, at least one or more of the ribs may also run in the circumferential direction. Particularly in combination with ribs which run parallel to the longitudinal axis of the propellant charge body, this allows the rib structure (rib network) to be designed to be more robust overall, because of the ribs which run in the circumferential direction.

Furthermore, it is feasible for at least one or more of the ribs to run obliquely with respect to the longitudinal axis and obliquely with respect to the circumferential direction of the propellant charge body. In particular, a rib which runs in a spiral shape around the base body is feasible. A plurality of spiral ribs—preferably with a constant pitch height—may also be arranged with offset phases around the base body. It is also possible to combine obliquely oriented ribs with ribs which are oriented parallel, and/or ribs which run in the circumferential direction.

According to another advantageous embodiment of the present invention, the radial projections are preferably in the form of studs or arrays. In this case, arrays means in particular square or circular outward bulges, which have substantially the same extent in all directions. The configuration of the radial projections in the form of studs or arrays makes it possible to enlarge the free space between the radial projections in comparison to the rib variant, without in the process having to accept any losses relating to the centring effect. This advantageously makes it possible to enlarge the space for the propellant charge body to break up into its propellant charge grains.

It is also possible to combine radial projections in the form of studs or arrays and radial projections in the form of ribs on one propellant charge body, in order to exploit the advantages of both projection forms.

According to one particularly preferred embodiment of the present invention, the composition of the material of the radial projections differs from the composition of the material of the base body. This allows the radial projections to carry out further advantageous functions in addition to the centring function, to be precise independently of optimization of the material of the base body.

Preferably, the material of which the base body which contains the propellant charge means consists comprises propellant charge grains which are compressed with one another by means of a binding agent. These propellant charge grains which are compressed with one another are designed to granulate into individual grains on ignition of the propellant charge body. This ensures uniform rapid combustion of the entire propellant charge means, which in turn ensures reproducible internal ballistics from one shot to another in the propellant charge chamber.

It is particularly advantageous for the material of the radial projections to have a considerably higher ignition temperature than the material of the propellant charge means—at least in the areas which touch the inner wall of the propellant charge chamber. This is because conventional propellant charge bodies without the radial projections according to the invention were subject to the problem that, if the propellant charge chamber were to be severely heated after relatively long continuous firing, the next propellant charge body to be inserted into the hot propellant charge chamber had a tendency to premature self-ignition, not in the intended firing sequence (cook-off effect). In this case, conventional propellant charge means based on nitrocellulose, which can also be used to produce the compressed propellant charge grains of the base body according to present invention, has an ignition temperature of about 160° C. However, if the material of the radial projections now has a considerably higher ignition temperature (that is to say a temperature which is higher by 80° C. to 120° C.), for example 280° C., this makes it possible to largely avoid dangerous self-ignition of the propellant charge body.

Cumulatively or as an alternative to the feature of the considerably higher ignition temperature of the material of the radial projections, the material of the radial projections may also have a low thermal conductivity. This makes it possible to achieve an advantageous effect against the cook-off effect, in particular when a propellant charge body remains in a propellant charge chamber that is hot from firing, over a relatively long time. This is because, in some circumstances, it is then not sufficient merely for the ignition temperature of the material of the radial projections to be higher than the temperature of the inner wall of the propellant charge chamber. As the heating of the material of the radial projections increases, it is then possible in some circumstances to reach the ignition temperature of the propellant charge means at the contact point between the radial projection and the base body. It is therefore particularly advantageous for the thermal conductivity of the material of the radial projections to be 200 mW/m·K (milliwatt per meter and Kelvin) or less.

Hard foam, in particular a polyurethane hard foam, is suitable for use as a component for the radial projections, as a material which is advantageous in terms of both of the aspects described above.

In this case, the hard foam is preferably provided with a pyrotechnic means which promote the combustion of the hard foam. This has the advantage that the material of the radial projections can burn away quickly and with as little residue as possible. In this case as well, it has once again been found to be advantageous for the pyrotechnic means which promote the combustion of the hard foam to have a considerably higher ignition temperature than the material of the propellant charge means of the base body. Octagon can be used for this purpose, which has the ignition temperature of about 280° C. as already mentioned above.

Advantageously, a layer is arranged between the material of the radial projections and the material of the base body, which layer prevents ingress of the material of the radial projections into the material of the base body—in particular during the process of application of the radial projections to the base body. This measure makes it possible to deliberately and selectively optimize the material of the radial projections on the one hand, and the material of the base body which contains the propellant charge means on the other hand.

In this case, the layer between the material of the radial projections and the material of the base body is preferably manufactured from a material which is consumed as quickly and completely as possible as a consequence of the heat developed on ignition of the propellant charge body. In this case in particular a thin plastic layer may be used, whose thickness may preferably be in the range between 0.01 mm and 0.2 mm.

According to one particularly preferred embodiment of the present invention, the base body of the propellant charge body is surrounded over its entire circumference by the material of the radial projections. In this case, however, the material thickness between the radial projections is preferably less than in the area of the radial projections. Since the base body is surrounded by material with low thermal conductivity over its entire circumference, the base body is even better protected against the introduction of heat from the hot inner wall of the propellant charge chamber. Particularly when using polyurethane hard foam, the air inclusions in the hard foam cells ensure good insulation and low thermal conductivity.

Furthermore, it is advantageous for the propellant charge body to be essentially in the form of a cylinder whose edges are chamfered. The conical inclination on the cylinder edges allows the propellant charge body to be inserted easily into the propellant charge chamber even when the center longitudinal axes of the propellant charge chamber and the propellant charge body do not coincide exactly.

Other features which are considered as characteristic for the invention are set forth in the appended claims.

Although the invention is illustrated and described herein as embodied in a propellant charge body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
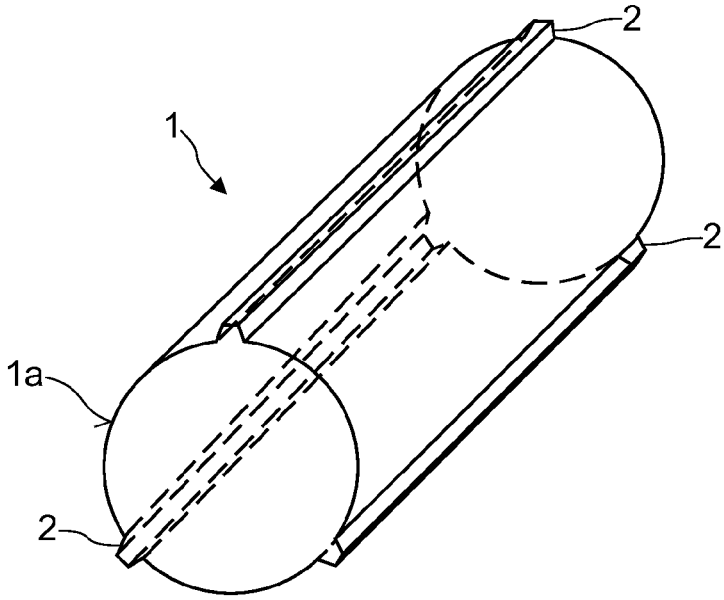
FIGS. 1A and 1B show one embodiment of the propellant charge body according to the invention (in perspective and in the form of a section view at right angles to the center longitudinal axis)
Figure 1B:
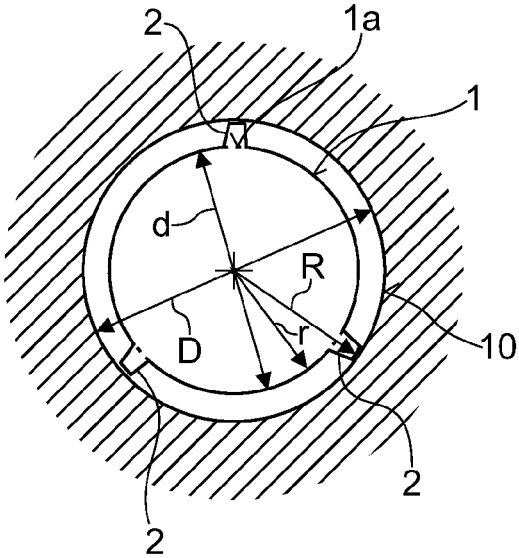

Referring now to the figures of the drawing in detail and first, particularly, to FIGS. 1A and 1B thereof, there is shown the basic design of an exemplary propellant charge body 1 according to the invention. The propellant charge body 1 is intended to be inserted into a propellant charge chamber 10 in a firearm for firing caseless ammunition. The propellant charge body 1 has a base body 1*a* which contains a propellant charge or propellant charge means. The base body 1*a* has a smaller diameter d than the internal diameter D of the propellant charge chamber 10. Radial projections 2 are arranged in one or more subareas on the circumference of the base body 1*a* and match the radius r of the base body 1*a* in these subareas to the internal radius R of the propellant charge chamber 10. In FIGS. 1A and 1B, there are a total of three subareas in which the radial projections 2 are arranged (that is to say three radial projections). However, this specific number should be understood as being purely exemplary, and is not intended to restrict the subject matter of the invention to this number in any way.

Figure 2:
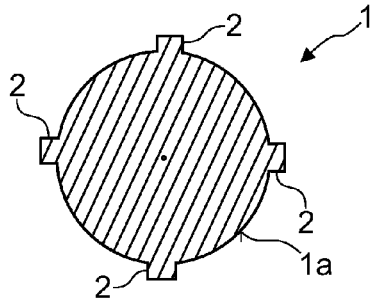
FIG. 2 shows a further embodiment of the propellant charge body according to the invention (in the form of a section view)

FIG. 2 shows a further embodiment of the propellant charge body 1, in which the base body 1*a* has the radial projections 2 on mutually opposite sides of the circumference. In this case, the projections are each arranged in pairs axially symmetrically with respect to the center longitudinal axis of the propellant charge body 1.

Figure 3A:
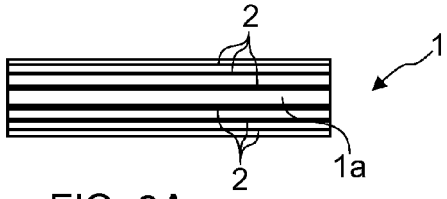
FIGS. 3A to 3E show a plurality of embodiments of the propellant charge body according to the invention with radial projections in the form of ribs (in the form of a side view)

FIGS. 3A to 3E show various embodiments of a propellant charge body 1 having radial projections 2 in the form of ribs. Ribs means elongated outward bulges which have a greater extent in one direction than transversely with respect to this direction. For example, FIG. 3A shows a propellant charge body 1 having a plurality of ribs 2 which run parallel to the longitudinal axis of the propellant charge body 1. As shown in FIG. 3A, both the width of all the ribs 2 and the distances between two adjacent ribs 2 are preferably each the same. However, the width of the individual ribs 2 is preferably less than the distance between adjacent ribs 2, in order to produce as much free space as possible between the ribs 2.

Figure 3B:
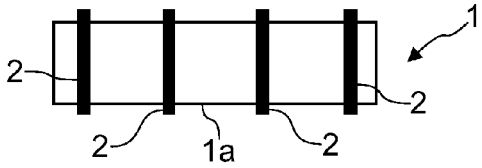
Figure 3C:
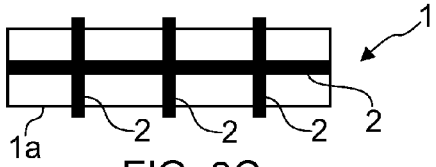

FIG. 3B illustrates ribs 2 which run in the circumferential direction. In FIG. 3C, the propellant charge body 1 has a combination of ribs 2 which run parallel to the longitudinal axis of the propellant charge body 1 and ribs 2 which run in the circumferential direction. A combination such as this makes it possible to produce a type of network on the base body 1*a* of the propellant charge body 1.

Figure 3D:
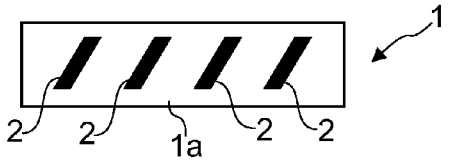

FIG. 3D shows ribs 2 which run obliquely with respect to the longitudinal axis and obliquely with respect to the circumferential direction of the propellant charge body 1. The oblique profile of the ribs 2 may in this case be provided at any desired angles with respect to the longitudinal axis or with respect to the circumferential direction. An oblique orientation of 45° with respect to the longitudinal axis and with respect to the circumferential direction represents a preferred inclination orientation, however, particularly with a combination of obliquely oriented ribs 2 having ribs 2 which run parallel to the longitudinal axis of the propellant charge body 1 and/or ribs 2 which run in the circumferential direction, because this then results in uniformly large intermediate spaces between the differentially oriented ribs 2.

Figure 3E:
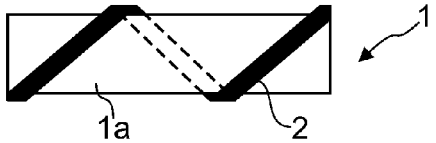

As is shown in FIG. 3D, by way of example, the obliquely running ribs may each extend over a distance which is only short in comparison to the total circumference of the base body 1, although, as shown in FIG. 3E by way of example, they may also be wound one or more times around the base body 1*a*, in the form of a spiral. Furthermore, a spiral configuration of the ribs 2 also allows a plurality of spiral ribs to be wound into one another, as in the case of a screw.

Figure 3F:
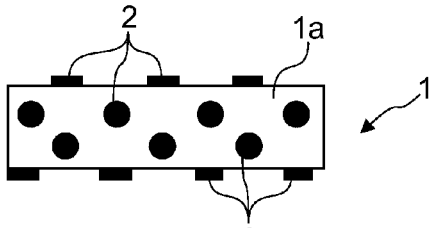
FIGS. 3F and 3G show two embodiments of the propellant charge body according to the invention with radial projections in the form of studs or arrays (in the form of a side view)
Figure 3G:
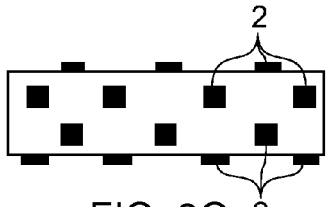

FIGS. 3F and 3G show a propellant charge body 1 having radial projections 2 in the form of studs or arrays. Arrays means square or circular output bulges which have substantially the same extent in all directions. For example, FIG. 3F shows a propellant charge body 1 having round arrays or studs distributed uniformly over the circumference of the base body 1*a*. FIG. 3G shows an arrangement, which is likewise regular, of square arrays on the circumference of the base body 1*a* of the propellant charge body 1.

The advantage of the embodiment of the radial projections 2 in the form of studs or arrays over the embodiment of the radial projections 2 in the form of ribs is that, assuming that the height of the radial projections 2 is the same, the embodiment of the radial projections 2 in the form of arrays allows the intermediate spaces between the radial projections 2 to have a greater volume than the embodiment of the radial projections 2 in the form of ribs.

The compositions of the material of the radial projections 2 and of the material of the base body 1*a* may differ from one another. This is advantageous with respect to the optimization, which in some cases is contradictory, of the characteristics of the radial projections 2 and the characteristics of the base body 1*a*. By way of example, the requirements for mechanical strength, temperature resistance and thermal conductivity for the material of the radial projections 2 may lead to a different material choice than from the material of the base body 1*a*.

Figure 4:
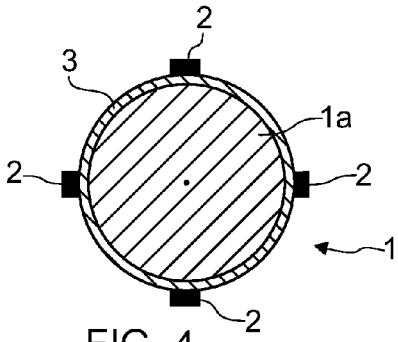
FIG. 4 shows a further embodiment of the propellant charge body according to the invention with a layer between the material of the radial projections and the material of the base body (in the form of a section view)

FIG. 4 shows a propellant charge body 1 such as this in which the composition of the material of the radial projections 2 differs from the material of the base body 1*a*. In this case, a layer 3 is preferably arranged between the material of the radial projections 2 and the material of the base body 1*a*, which layer 3 prevents ingress of the material of the radial projections 2 into the material of the base body 1*a*, particularly during the application process of the radial projections 2 to the base body 1*a*. However, it should be stressed that the use of the intermediate layer 3 in no way represents an essential precondition when using different materials for radial projections 2 and the base body. In fact, the use of the intermediate layer 3 represents an optional measure, although it is also advantageous. The layer 3 is preferably manufactured from a material which is consumed as quickly and completely as possible as a result of the heat which is developed on ignition of the propellant charge body 1, as a result on which no combustion residues remain in the propellant charge chamber 10. In particular, a thin plastic layer may be used here, preferably having a thickness of a few hundredths of a millimeter. A layer thickness such as this itself ensures prevention of ingress of the material of the radial projections during their application process to the base body 1*a*.

Ideally, the radial projections 2 are composed of a material which has a high ignition temperature and/or low thermal conductivity. These two characteristics—alternatively or cumulatively—make it possible to reduce the cook-off risk for the base body 1*a*, which ignites at a low temperature, of the propellant charge body 1. It is also advantageous for the material of the radial projections 2 to burn away as quickly as possible and with as little residue as possible, in order to avoid residues in the propellant charge chamber 10, which could otherwise lead to defects in the weapon system. It is also advantageous for the (desired) combustion of the material of the radial projections 2 to make as little contribution as possible to the internal ballistics. This means that the aim is to produce as little pressure/volume work as possible during combustion of the material of the radial projections 2, in order to corrupt the internal ballistics, which are predefined by the base body 1*a*, as little as possible, and keep them consistently reproducible.

A material which advantageously intrinsically combines all the characteristics mentioned above is hard foam, in particular polyurethane hard foam. It is possible to ensure that the hard foam burns away in an advantageous manner without any residue by adding a pyrotechnic means, which promote the combustion of the hard foam, to the hard foam. In particular octogen can be used for this purpose, which has a considerably higher ignition temperature than the material of the propellant charge means of the base body 1*a*, specifically about 280° C. Even a relatively small component of octogen is sufficient for this purpose, as a result of which the octogen does not make any significant contribution to the internal ballistics, as is in fact desirable, as already mentioned above.

Figure 5:
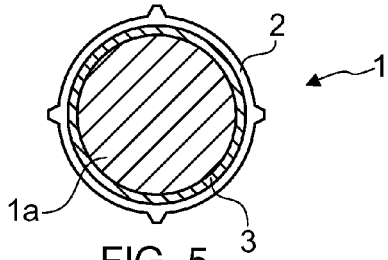
FIG. 5 shows a further embodiment of the propellant charge body according to the invention, in which the base body of the propellant charge body is surrounded by the material of the radial projections over its entire circumference (in the form of a section view)

FIG. 5 shows one particularly preferred embodiment of a propellant charge body 1 according to the invention, in which the base body 1*a* is surrounded by the material of the radial projections 2 over its entire circumference. The material thickness between the radial projections 2 is in this case less than in the area of the radial projections 2. The statements already made in conjunction with FIG. 4 are also applicable here: The arrangement of the intermediate layer 3 is advantageous, but not absolutely essential. A particularly good thermal insulation effect is achieved by the complete sheathing of the base body 1*a*, which may also cover the end surfaces of the propellant charge body 1. Particularly when using polyurethane hard foam, the air inclusions in the foam chambers ensure a very good insulation effect. This may be advantageous particularly if a propellant charge body 1 remains in a propellant charge chamber 10 which is hot because of firing, for a relatively long time.

Figure 6:
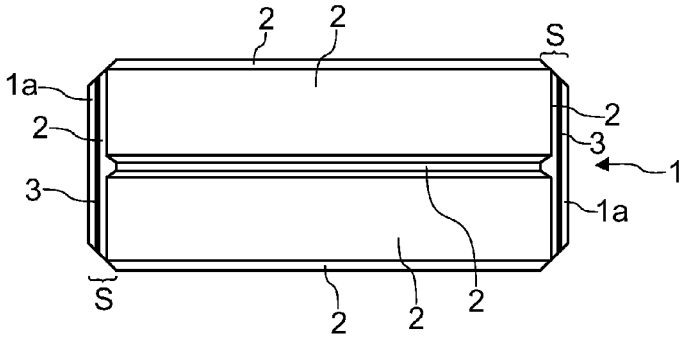
FIG. 6 shows a further embodiment of the propellant charge body according to the invention with chamfered edges (in the form of a side view).

FIG. 6 shows an additional optional feature which has a positive effect on the capability to insert the propellant charge body 1 according to the invention into the propellant charge chamber 10. For example, the propellant charge body 1 is essentially in the form of a cylinder whose edges are chamfered S. This conical geometry of the ends of the propellant charge body 1 results in a funnelling effect during the process of inserting the propellant charge body 1 into the propellant charge chamber 10. This funnelling effect can also be assisted by a conical chamfer on the insertion hole in the propellant charge chamber 10.

The invention claimed is:

1. A propellant charge body for insertion into a propellant charge chamber in a firearm for firing caseless ammunition, the propellant charge body comprising:

a base body containing a propellant charge and having a diameter less than an internal diameter of the propellant charge chamber; and radial projections formed in one or more subareas on a circumference of said base body, said radial projections projecting from said base body and matching a radius of said base body in said one or more subareas to an internal radius of the propellant charge chamber;

said radial projections formed of a hard foam including pyrotechnic means that promotes a combustion of said hard foam and that has a significantly higher ignition temperature than a material of said propellant charge of said base body.

2. The propellant charge body according to claim 1, wherein said radial projections are formed on respectively opposite sides of the circumference of said base body.

3. The propellant charge body according to claim 1, wherein said radial projections are ribs formed on said base body.

4. The propellant charge body according to claim 3, wherein at least one or more of said ribs run parallel to a longitudinal axis of the propellant charge body.

5. The propellant charge body according to claim 3, wherein at least one or more of said ribs run in a circumferential direction of the propellant charge body.

6. The propellant charge body according to claim 3, wherein at least one or more of said ribs run obliquely with respect to a longitudinal axis and with respect to a circumferential direction of the propellant charge body.

7. The propellant charge body according to claim 1, wherein said radial projections are studs or arrays formed on said base body.

8. The propellant charge body according to claim 1, wherein a composition of a material of said radial projections differs from a composition of a material of said base body.

9. The propellant charge body according to claim 8, which comprises a layer arranged between the material of said radial projections and the material of said base body, said layer prevent ingress of the material of said radial projections into the material of said base body.

10. The propellant charge body according to claim 9, wherein said layer is configured to prevent ingress of the material of said radial projections into the material of said base body during a process of application of said radial projections to said base body.

11. The propellant charge body according to claim 9, wherein said layer is manufactured from a material which is consumed as quickly and completely as possible as a consequence of heat generated on ignition of said propellant charge body.

12. The propellant charge body according to claim 11, wherein said layer is a thin plastic layer.

13. The propellant charge body according to claim 8, wherein said base body is surrounded over an entire circumference thereof by the material of said radial projections, with a material thickness between said radial projections being less than in an area of said radial projections.

14. The propellant charge body according to claim 1, wherein a material of said base body containing said propellant charge comprises propellant charge grains that are compressed with one another with a binding agent and are configured to granulate into individual grains on ignition of said propellant charge.

15. The propellant charge body according to claim 1, wherein said radial projections consist of polyurethane.

16. The propellant charge body according to claim 1, wherein said pyrotechnic means is octogen.

17. The propellant charge body according to claim 1, wherein said propellant charge body is a substantially cylindrical body with chamfered edges.

18. The propellant charge body according to claim 1, wherein said pyrotechnic means includes octogen.

* * * * *